US008661613B2

(12) United States Patent
Marsh et al.

(10) Patent No.: US 8,661,613 B2
(45) Date of Patent: Mar. 4, 2014

(54) STEERABLE UPRIGHT VACUUM CLEANER

(75) Inventors: Samuel A. Marsh, Ligonier, PA (US); Michael L. Fry, Danville, KY (US); James T. Crouch, Danville, KY (US); Kyle A. Hawkins, Stanford, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 341 days.

(21) Appl. No.: 13/223,615

(22) Filed: Sep. 1, 2011

(65) Prior Publication Data

US 2012/0167335 A1 Jul. 5, 2012

Related U.S. Application Data

(60) Provisional application No. 61/429,940, filed on Jan. 5, 2011.

(51) Int. Cl.
*A47L 9/00* (2006.01)

(52) U.S. Cl.
USPC ..... 15/411; 15/351

(58) Field of Classification Search
USPC ..... 15/347, 350, 351, 411, 410, 415.1
See application file for complete search history.

(56) References Cited

U.S. PATENT DOCUMENTS

| | | | | |
|---|---|---|---|---|
| 1,139,736 | A | 5/1915 | Stabel | |
| 2,038,697 | A | 4/1936 | Winslow | |
| 2,162,313 | A | 6/1939 | McCabe et al. | |
| 5,323,510 | A | 6/1994 | Redding et al. | |
| 5,381,577 | A | 1/1995 | Lilja | |
| 5,511,282 | A * | 4/1996 | Metzger et al. | 15/412 |
| 5,584,095 | A | 12/1996 | Redding et al. | |
| 5,794,305 | A | 8/1998 | Weger | |
| 6,055,703 | A | 5/2000 | Redding et al. | |
| 6,334,234 | B1 * | 1/2002 | Conrad et al. | 15/347 |
| 6,519,810 | B2 * | 2/2003 | Kim | 15/415.1 |
| 6,553,613 | B2 * | 4/2003 | Onishi et al. | 15/351 |
| 7,805,804 | B2 | 10/2010 | Loebig | |
| 8,151,408 | B2 * | 4/2012 | Finke et al. | 15/327.2 |
| 8,272,097 | B2 * | 9/2012 | Poetting | 15/351 |
| 2005/0223516 | A1 | 10/2005 | Courtney | |
| 2005/0223517 | A1 | 10/2005 | Courtney | |
| 2005/0235454 | A1 | 10/2005 | Courtney | |

FOREIGN PATENT DOCUMENTS

WO WO2004/014211 A1 2/2004

* cited by examiner

*Primary Examiner* — Dung Van Nguyen
(74) *Attorney, Agent, or Firm* — King & Schickli, PLLC

(57) ABSTRACT

An upright vacuum cleaner includes a body having a nozzle assembly and a handle assembly. The nozzle assembly includes a suction inlet and a pivot. A suction generator and a dirt collection vessel are both carried on the body. A connecting arm pivotally connects the handle assembly to the nozzle assembly. The connector arm includes (a) a hub received on the pivot so as to provide a first pivotal connection along a first axis and (b) a trunion providing a second pivotal connection about which the handle assembly is tilted.

20 Claims, 16 Drawing Sheets

STEERABLE UPRIGHT VACUUM CLEANER

This application claims the benefit of U.S. Provisional Patent Application Ser. No. 61/429,940, filed on 5 Jan. 2011, the full disclosure of which is incorporated herein by reference.

TECHNICAL FIELD AND INDUSTRIAL APPLICABILITY OF THE INVENTION

This document relates generally to the floor care equipment field and more particularly to an upright vacuum cleaner including a twin pivot connecting arm providing enhanced maneuverability.

BACKGROUND OF THE INVENTION

Upright vacuum cleaners have long been known in the art. Upright vacuum cleaners generally include a nozzle assembly having a bottom plate with a suction inlet that rides over the floor. Typically, a rotary agitator is provided in the suction inlet. A control handle or canister assembly is pivotally connected to the nozzle assembly. The control handle is rocked rearwardly into an oblique, use position as the operator manipulates the vacuum cleaner to and fro across the floor to be cleaned.

In the past, the pivotal connection between the nozzle assembly and canister assembly on most upright vacuum cleaners incorporated a single pivot axis extending in a line transverse to the nozzle assembly and parallel to the suction inlet. While such an arrangement provides effective control for guiding the vacuum cleaner, it does not provide an attack angle that allows an operator to initiate turns efficiently for ease of operation and maximum control.

The present invention relates to a new and improved upright vacuum cleaner including a twin pivot connecting arm between the nozzle assembly and handle or canister assembly that provides for enhanced maneuverability and ease of operation.

SUMMARY OF THE INVENTION

An upright vacuum cleaner is provided comprising a body including a nozzle assembly and a handle assembly. The nozzle assembly includes a suction inlet and a pivot. Both a suction generator and a dirt collection vessel are carried on the body. In addition, a connector arm pivotally connects the handle assembly to the nozzle assembly. That connector arm includes (a) a hub received on the pivot in order to provide a first pivotal connection along a first axis and (b) a trunion providing a second pivotal connection about which the handle assembly is tilted.

More specifically describing the upright vacuum cleaner, the pivot is an airstream conduit carried on the nozzle assembly. That air stream conduit provides a fluid connection between the dirt collection vessel and the suction generator. The handle assembly further includes a receiver that receives and holds the trunion. A pin secures the handle assembly to the trunion of the connector arm. More specifically, the receiver includes a socket that receives a first end of the trunion while the pin is received in a second end of the trunion. In addition, the connector arm includes a first portion and a second portion. The first and second portions are connected together to form the hub. Further, the trunion is provided on the first portion.

BRIEF DESCRIPTION OF THE DRAWINGS

The accompanying drawings incorporated herein and forming a part of the specification, illustrate several aspects of and together with the description serve to explain certain principles of a vacuum cleaner. In the drawings:

FIGS. 9*a* and 9*b* are detailed cross sectional views illustrating the cooperating cam structures provided on the nozzle assembly and handle assembly to vertically orient the handle assembly into a stable, storage position with respect to the nozzle assembly.

Reference will now be made in detail to the present preferred embodiment of the invention, examples of which are illustrated in the accompanying drawings.

DETAILED DESCRIPTION OF THE PREFERRED EMBODIMENTS OF THE INVENTION

Figure 1:
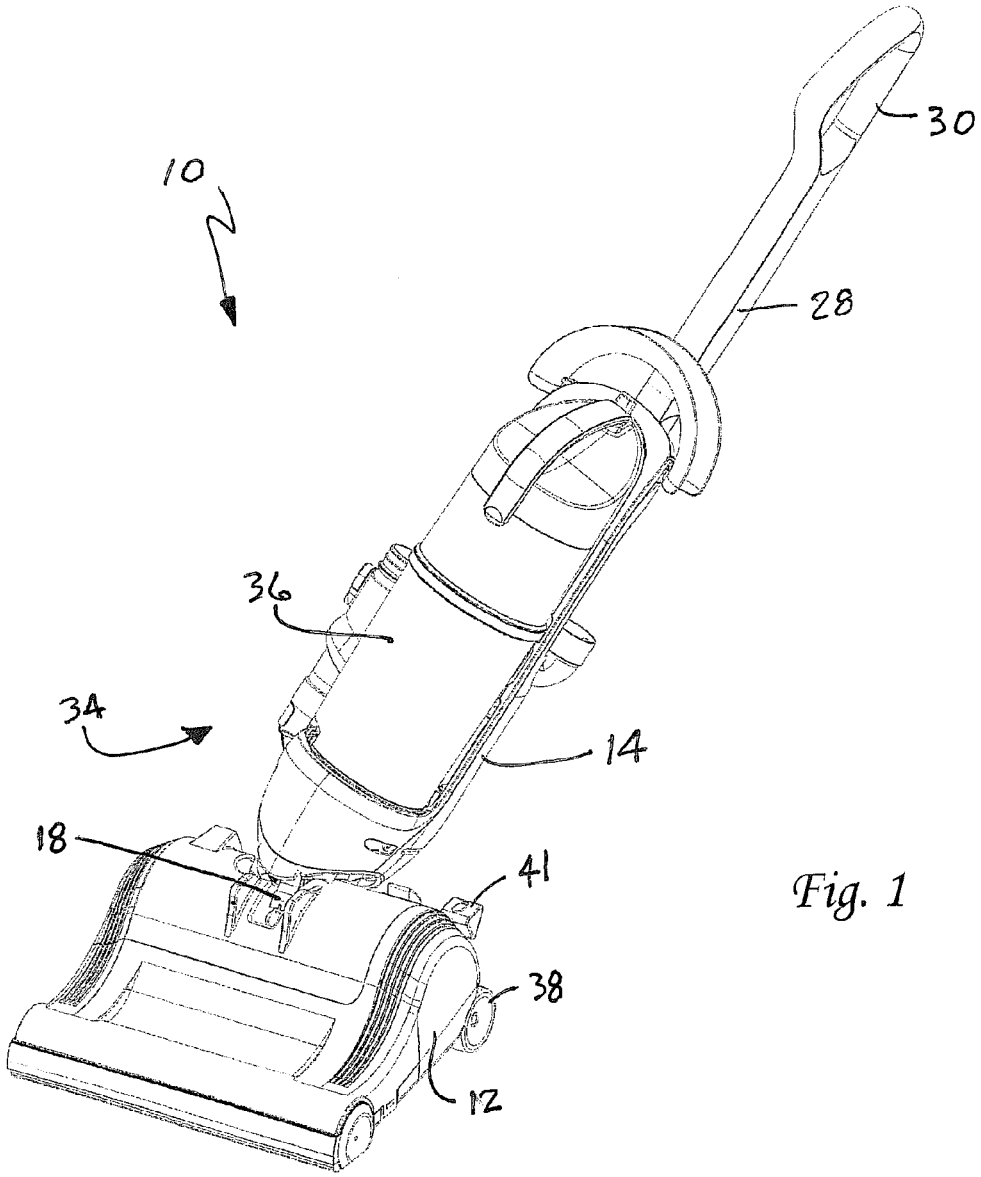
FIG. 1 is a perspective view illustrating a vacuum cleaner.
Figure 2A:
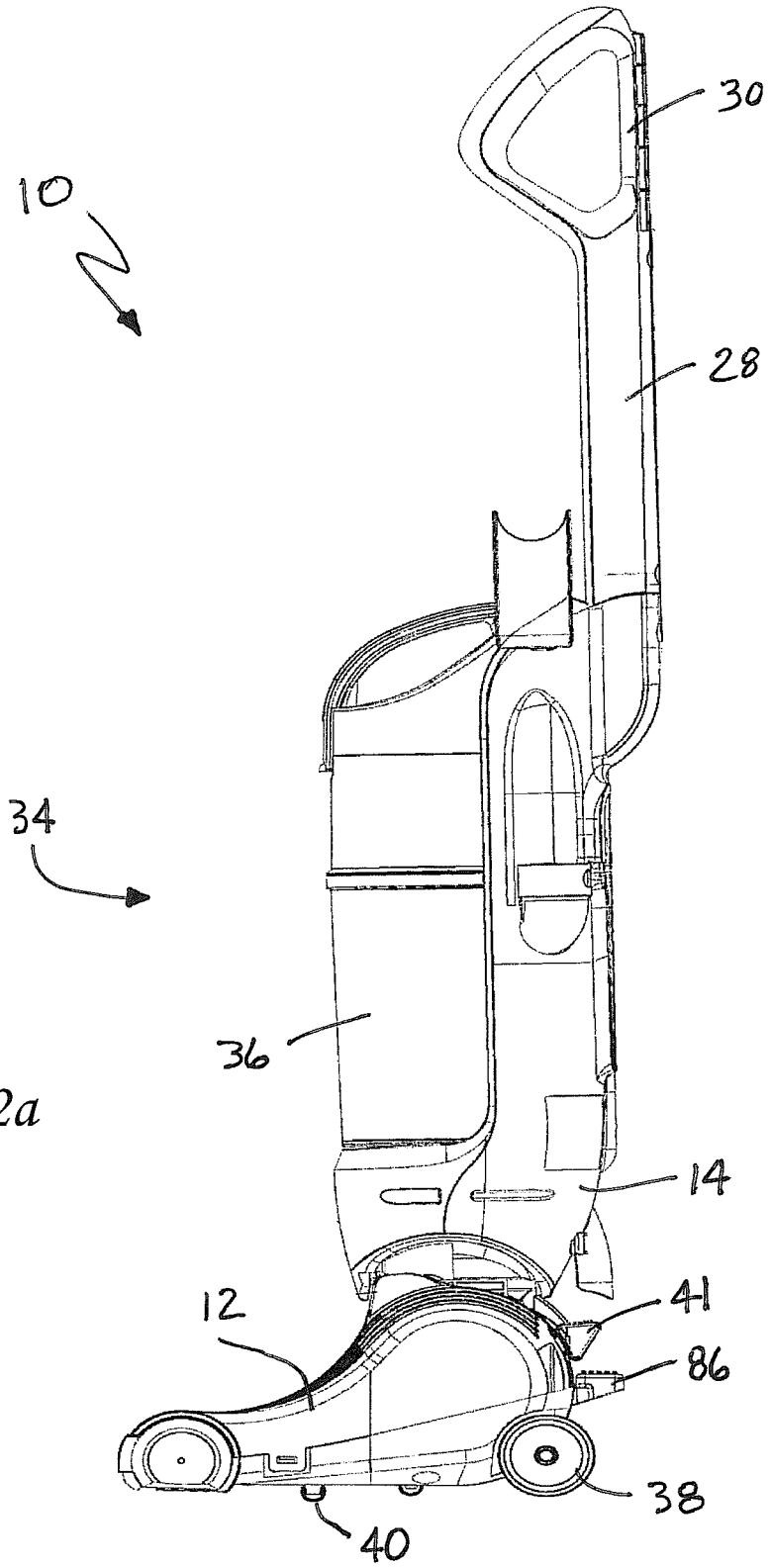
FIGS. 2*a* and 2*b* are left side elevational views of the vacuum cleaner illustrating, respectively, the handle assembly in the upright storage position and a lowered or inclined operating position.
Figure 2B:
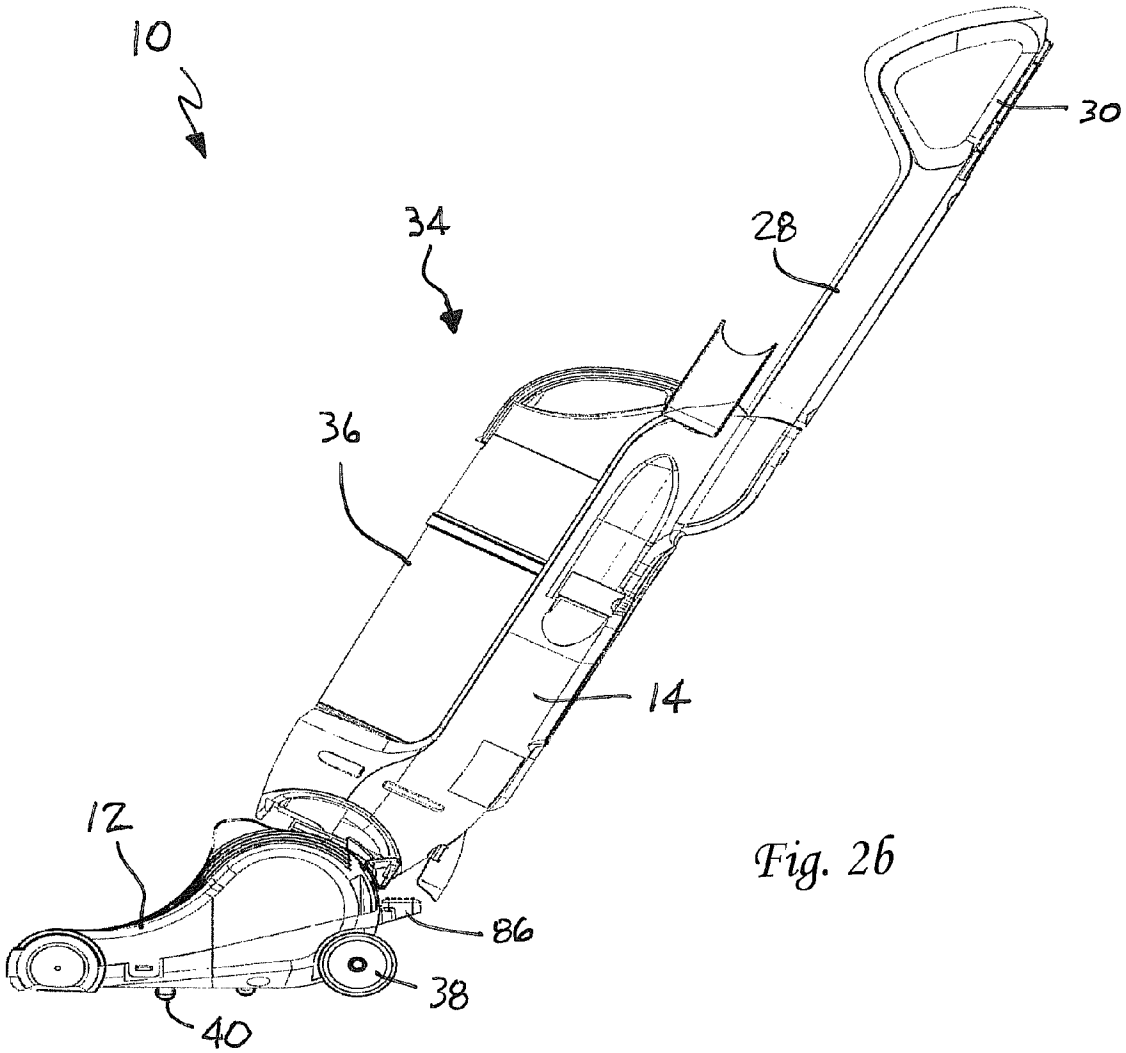
Figure 3:
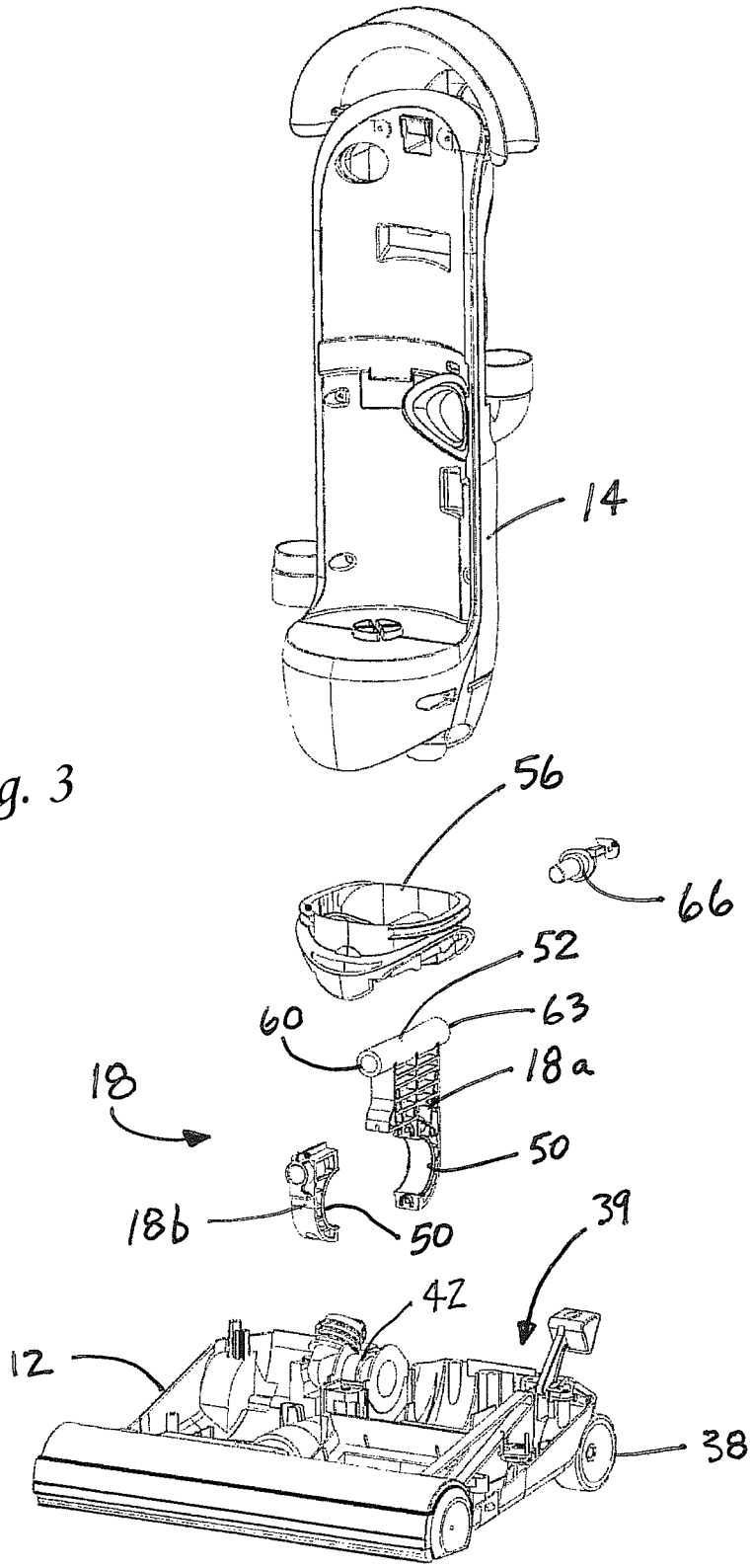
FIG. 3 is an exploded perspective view illustrating the connector arm that pivotally connects the handle and nozzle assemblies.
Figure 4:
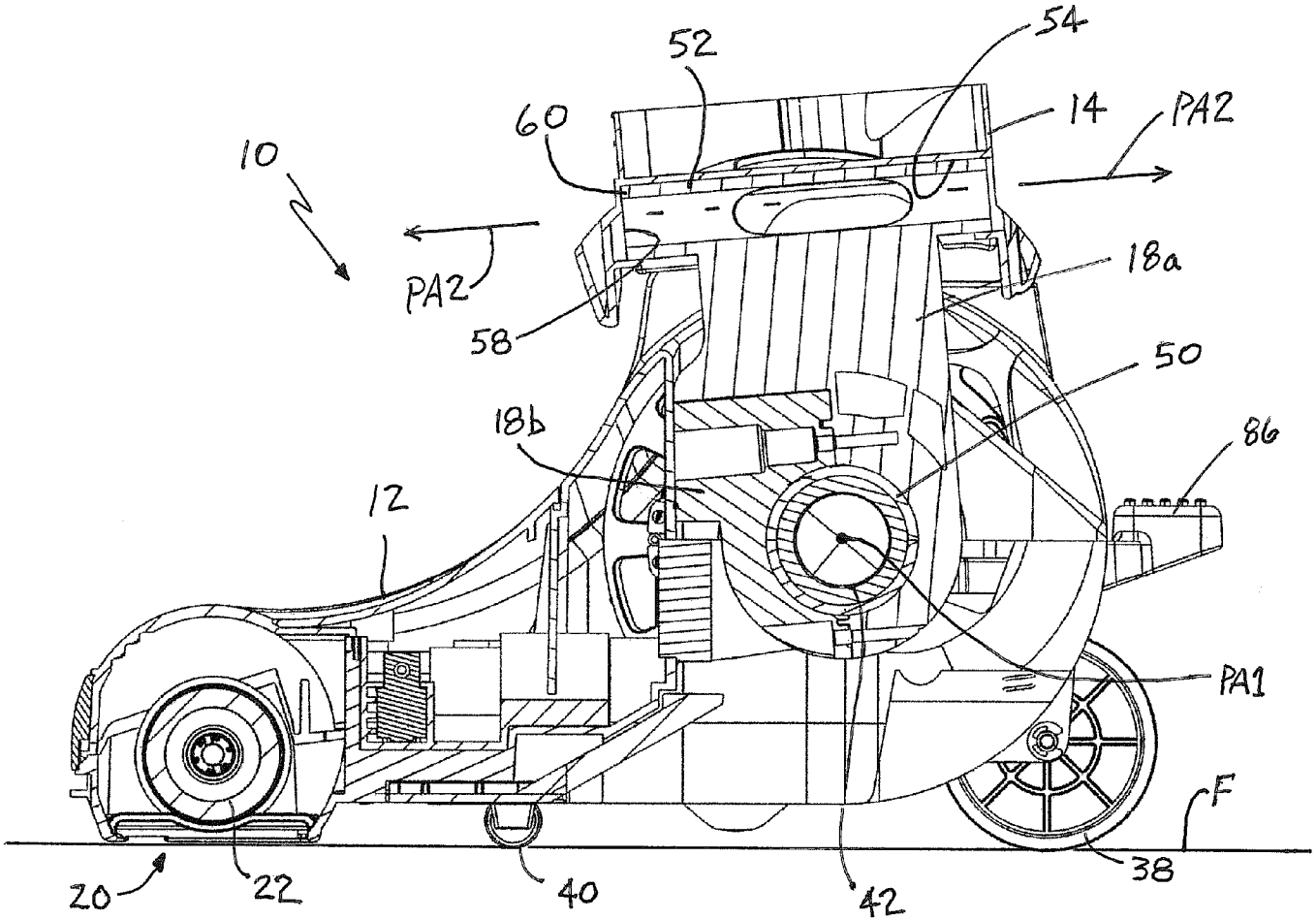
FIGS. 4 and 5 are detailed cross sectional views illustrating the pivotal connection of the connector arm to the pivot or airstream conduit carried on the nozzle assembly and leading to the suction generator.
Figure 5:
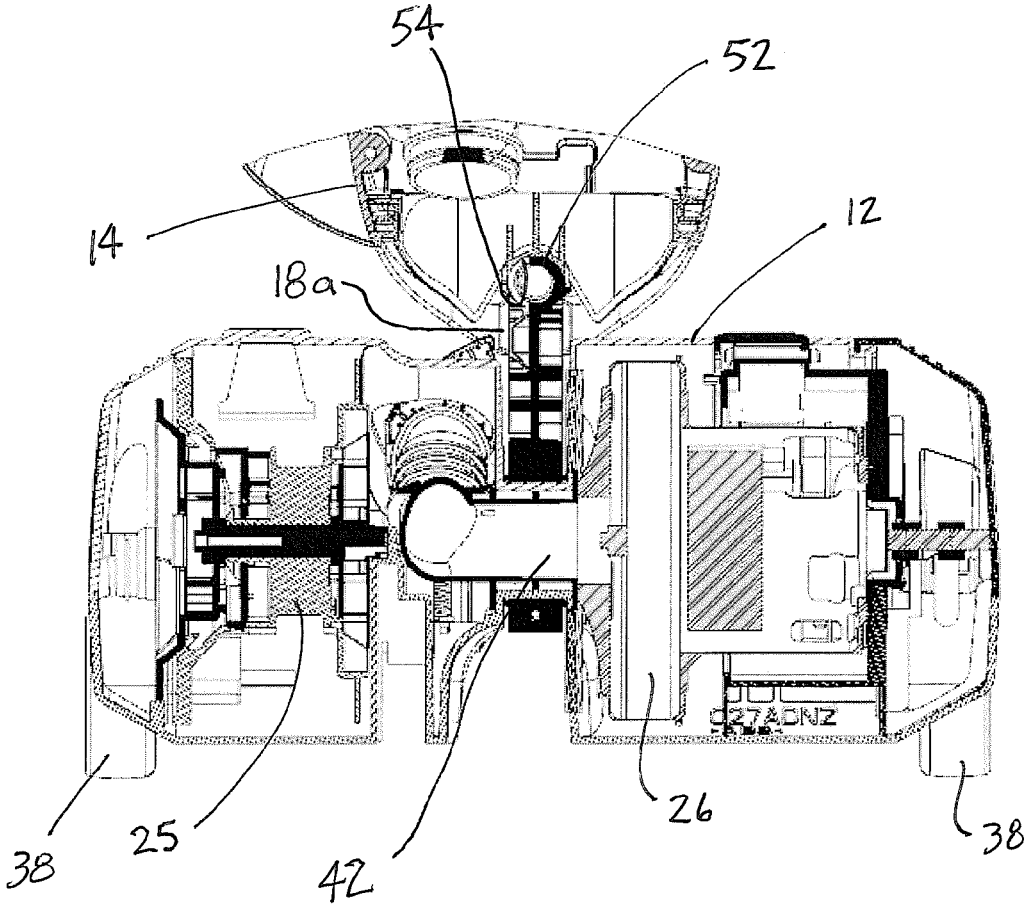
Figure 6A:
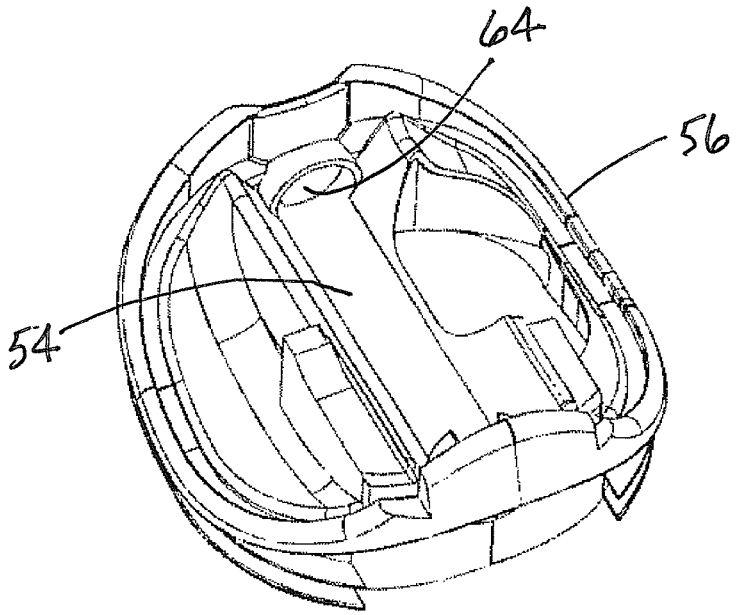
FIGS. 6*a* and 6*b* are detailed perspective views of the bottom housing end of the handle assembly including the receiver that receives the trunion on the end of the connector arm.
Figure 6B:
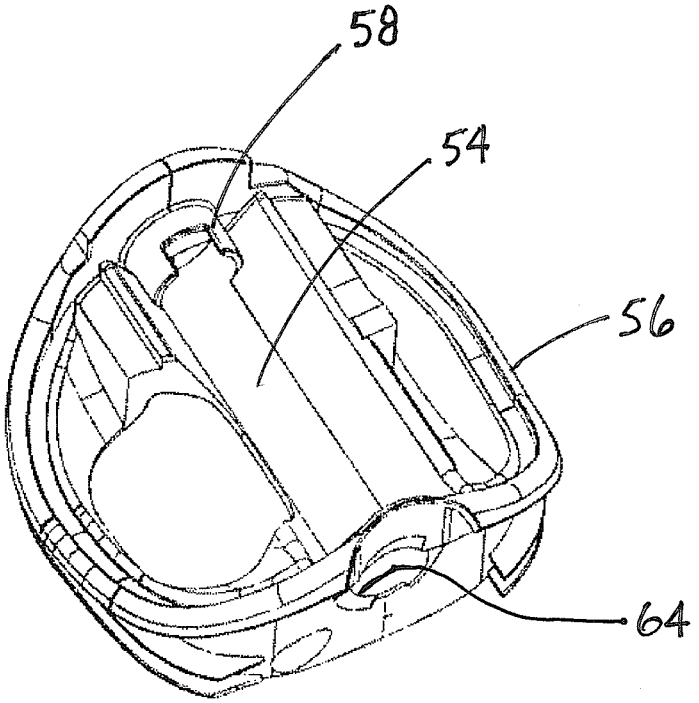
Figure 7:
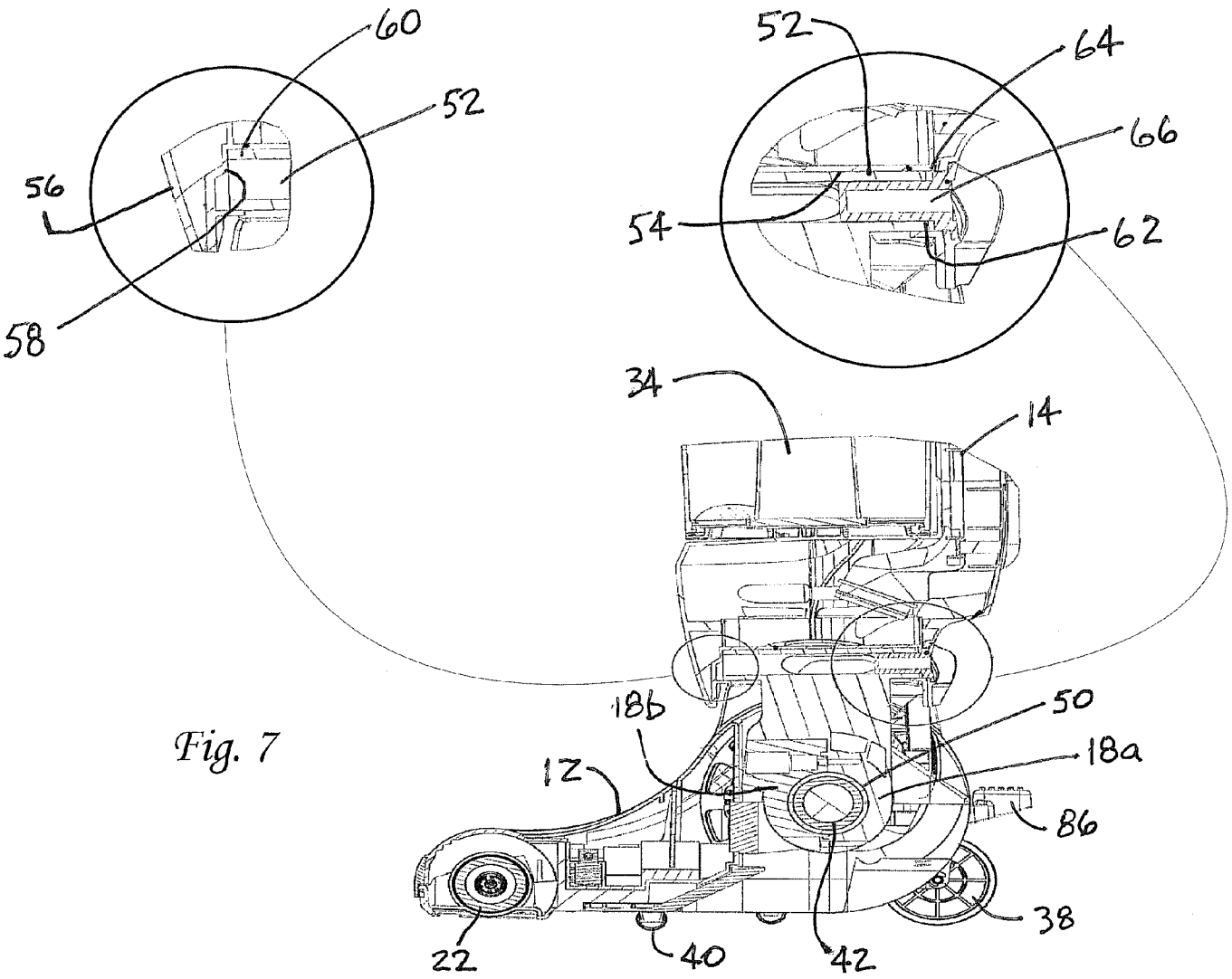
FIG. 7 is a cross sectional view illustrating the pin connection of the connector arm to the receiver of the handle assembly.

Reference is now made to FIGS. 1-3 showing an upright vacuum cleaner 10. The upright vacuum cleaner 10 includes a body comprising a nozzle assembly 12 and a canister or handle assembly 14. As will be described in greater detail below, the handle assembly 14 is pivotally connected to the nozzle assembly by means of a twin pivot connector arm 18.

Figure 1A:
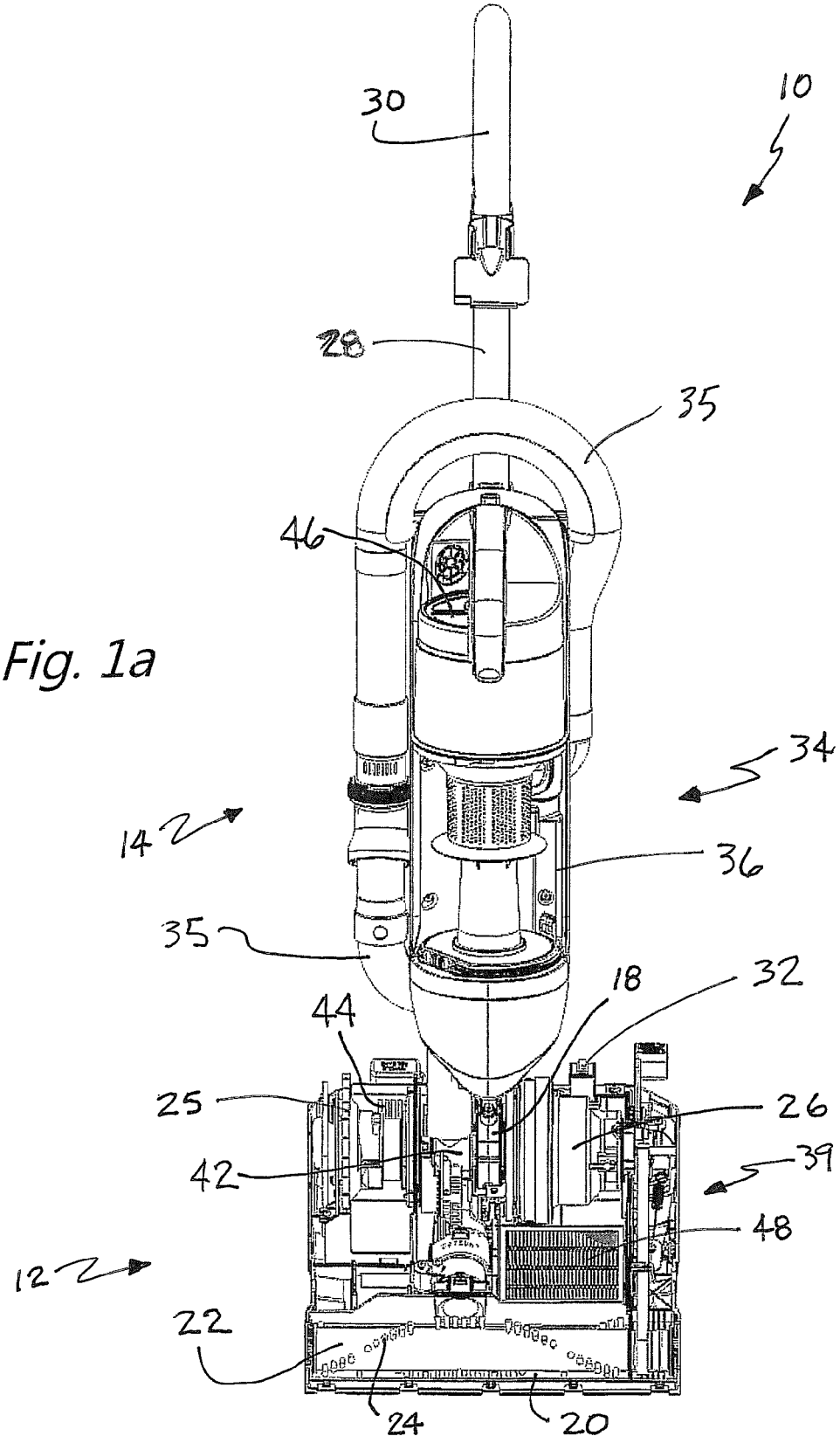
FIG. 1*a* is a schematical block diagram of the vacuum cleaner illustrated in FIG. 1.

As illustrated schematically in FIG. 1*a*, the nozzle assembly 12 includes a suction inlet 20. A rotary agitator 22 is carried on the nozzle assembly 12 in the mouth of the suction inlet 20. The rotary agitator 22 may be equipped with bristle tufts 24 or other projecting structures of a type known in the art to beat dirt and debris from the nap of an underlying carpet during the vacuum cleaner operation. The nozzle assembly 12 also carries a suction generator 26 which may, for example, comprise a combined motor and fan assembly. The rotary agitator 22 may be driven by the motor of the suction generator 26 through a PTO drive such as a belt and pulley system generally designated by reference numeral 39 in FIG. 3. Alternatively, the rotary agitator 22 may be driven by an independent agitator drive motor if desired. The nozzle assembly 12 also houses a cord reel 25 for extending and retracting an electrical power cord 27 for connecting the vacuum cleaner 10 to a standard electrical wall outlet.

The handle assembly 14 includes a control stalk 28 having a hand grip 30. In the illustrated embodiment, the switches 32 for controlling operation of the vacuum cleaner are provided on the nozzle assembly 12. However, it should be appreciated that the switches 32 could be provided along the control stalk 28 adjacent the hand grip 30. The handle assembly 14 also carries a dirt collection vessel generally designated by reference numeral 34. In the illustrated embodiment the dirt collection vessel 34 comprises a reusable dirt cup 36. The dirt cup 36 may include a cylindrical sidewall, a tangentially directed inlet and an axially directed outlet so as to provide cyclonic cleaning action. A primary filter may be provided in the dirt cup 36 or downstream from the dirt cup as desired. In an alternative embodiment the dirt collection vessel 34 may comprise a vacuum cleaner filter bag of a type known in the art held in a filter bag compartment provided in the handle assembly 14.

As noted above, electrical power is supplied to the vacuum cleaner 10 from a standard electrical wall outlet through an electrical cord 27. Alternatively or additionally, the vacuum cleaner 10 could be powered by battery if desired. The vacuum cleaner 10 is supported for movement along a floor on a series of wheels. More specifically as illustrated in FIGS. 2*a*, 2*b*, 8*a* and 9*a*, the nozzle assembly 12 carries a pair of a rear wheels 38 and one or more forward wheels 40 that allow for height adjustment of the vacuum cleaner 10 with respect to the floor. Such height adjustment is made by manipulating a height adjustment lever 40 that projects from the nozzle assembly 12 and is connected to a height adjustment mechanism (not shown) of a type known in the art. The lever 41 is depressed in order to release the lock that secures the handle assembly 14 in the upright storage position.

During normal vacuum cleaner operation, the rotary agitator 22 is driven by the motor of the suction generator 26 and functions to beat dirt and debris from the nap of an underlying carpet. The suction generator 26 also functions to draw a vacuum air stream into the suction inlet 20. Dirt and debris from the carpet is entrained in that airstream, which is then drawn by the suction generator 26 into the dirt collection vessel 34 through a conduit 35. Dirt and debris is captured in the dirt collection vessel 34 while relatively clean air is drawn through an air stream conduit 42 to the suction generator 26. More specifically, that air stream then passes through a secondary fine particle filter 46 before passing over the motor of the suction generator 26 to provide cooling. The exhaust air from suction motor 26 passes through a final filter 48 such as a HEPA filter, before passing over the cord reel 25 to cool the electrical contacts (not shown). The air is then exhausted through port 44 into the environment.

As noted above, the handle assembly 14 and the nozzle assembly 12 of the vacuum cleaner 10 are connected together by a twin pivot connector arm 18. More specifically, as illustrated in FIGS. 3-7, the connector arm 18 includes a first portion 18*a* and a second portion 18*b* that are connected together to form a hub 50. The hub 50 is pivotally connected to a pivot 42 on the nozzle assembly 12. More specifically, the pivot 42 comprises the air stream conduit that provides a section of the fluid connection between the dirt collection vessel 34 and the suction generator 26. It should be appreciated that the pivot conduit 42 is securely fixed in the nozzle assembly 12 so that the connector arm 18 pivots about the pivot/conduit along a first pivot axis PA1 that is substantially parallel to the floor F and transverse to the body of the vacuum cleaner 10. Thus, the axis PA1 allows the handle assembly 14 to be pivoted in the fore and aft directions.

As further illustrated in FIGS. 1, 3, 6*a*, 6*b* and 7, a trunion 52 is provided on the first portion 18*a* of the connector arm 18. A receiver 54 is provided along the bottom wall 56 of the handle assembly 14. The receiver 54 includes a socket 58 that receives and holds a first end 60 of the trunion 52. When the handle assembly 14 is properly positioned on the connector arm 18, the trunion 52 is fully received in the receiver 54 with the first end 60 of the trunion held in the socket 58. An aperture 62 in the second end 63 of the trunion is aligned with a second aperture 64 in a wall or boss of the handle assembly 14. A pin 66 is secured in the two apertures 62, 64 to complete the pivotal connection of the handle assembly 14 to the connector arm 18.

Figure 8A:
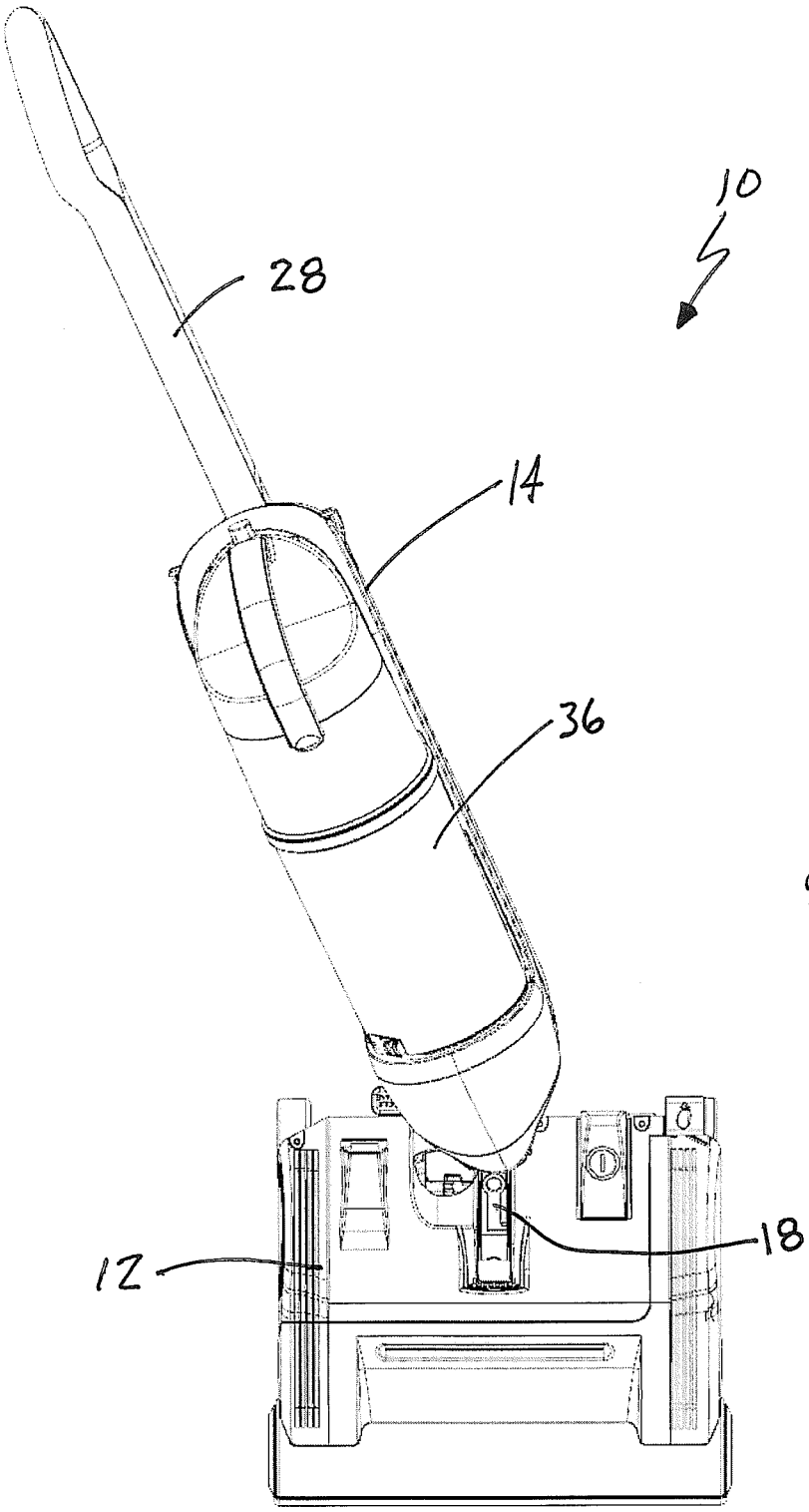
FIGS. 8*a*-8*c* are top plan views illustrating the handle assembly in an inclined, operative position for guiding the vacuum cleaner, respectively, to the right, straight ahead and to the left.
Figure 8B:
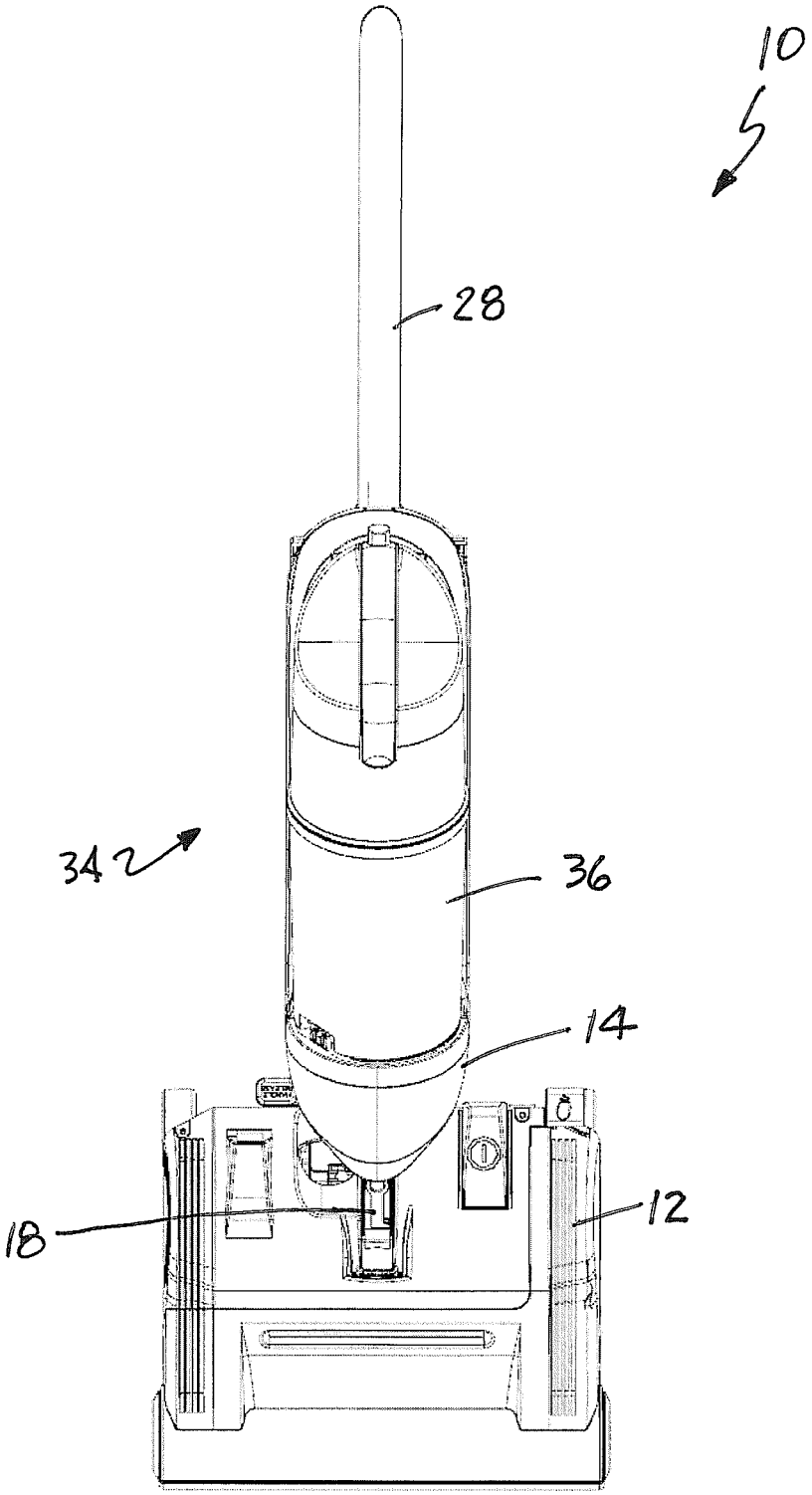
Figure 8C:
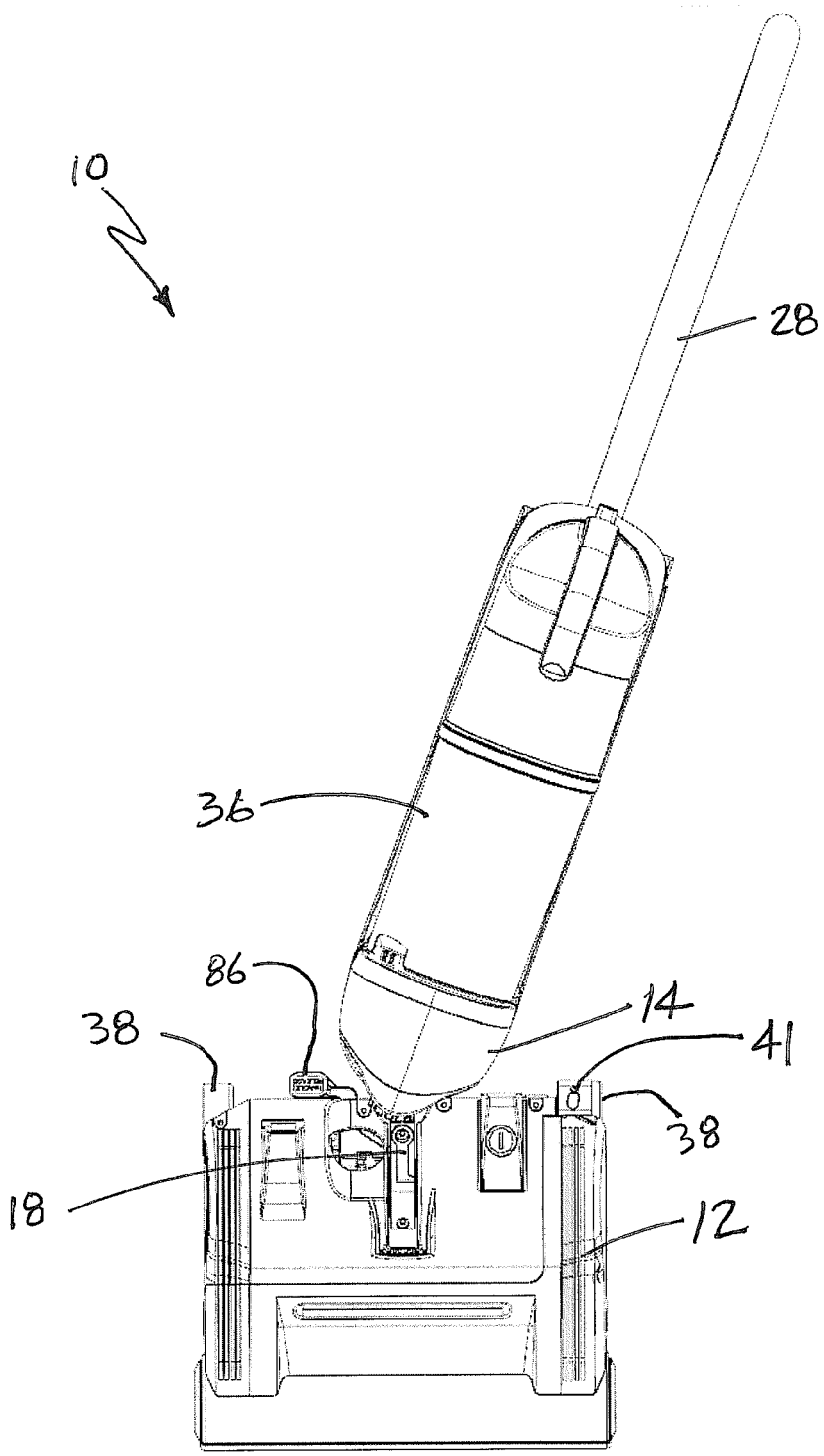

As should be appreciated from reviewing FIGS. 3, 4, 7 and 8*a*-8*c*, the handle assembly 14 pivots about a trunion 52 on a second pivot axis PA2 that is spaced between approximately 80 mm and about 120 mm from the first pivot axis PA1 and is substantially perpendicular to it. Thus, it should be appreciated that the connector arm 18 and the handle assembly 14 connected thereto may be pivoted upwardly and downwardly about the pivot axis PA1 while the canister assembly may be simultaneously pivoted on the trunion 52 of the connector arm 18 about the pivot axis PA2 from side-to-side in a substantially perpendicular direction. Together, the dual pivoting connection between the handle assembly 14 and nozzle assembly 12 provided by the connector arm 18 allows the vacuum cleaner 10 to be more easily manipulated in a desired direction by an operator. This is true whether the vacuum cleaner 10 is being manipulated straight forward as illustrated in FIG. 8*b*, directed to the right as illustrated in FIG. 8*a*, or directed to the left as illustrated in FIG. 8*c*.

More specifically, the connector arm 18 and handle assembly 14 may be pivoted about the pivot/air stream conduit 42 and the first pivot axis PA1 forward and backward through an arc of between approximately 0 and about 96 degrees. In addition, the handle assembly 14 may be pivoted transversely (i.e. from left to right) to the trunion 52 of the connector arm 18 about the second pivot axis PA2 through an arc of about 60 degrees: that is 30 degrees in each direction from a centerline position. Advantageously, the ability of the handle assembly 14 to pivot transversely or from left to right about the trunion 52 provides the operator with a better attack angle for manipulating/directing the vacuum cleaner 10 to quickly turn right or left as desired thereby enhancing maneuverability over vacuum cleaners of the prior art incorporating a single pivot connection between the nozzle and handle assemblies 12, 14.

Figure 9A:
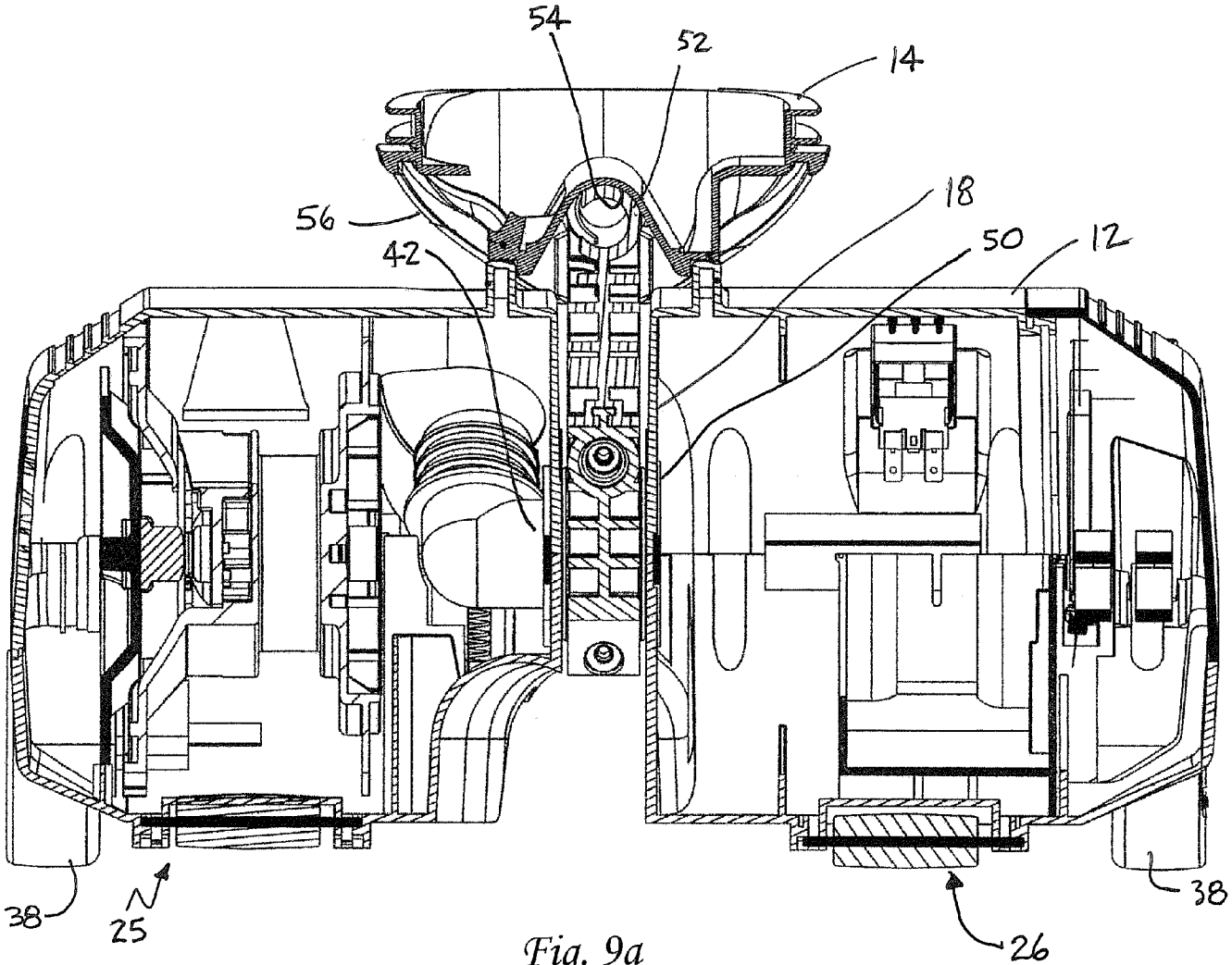
Figure 96:
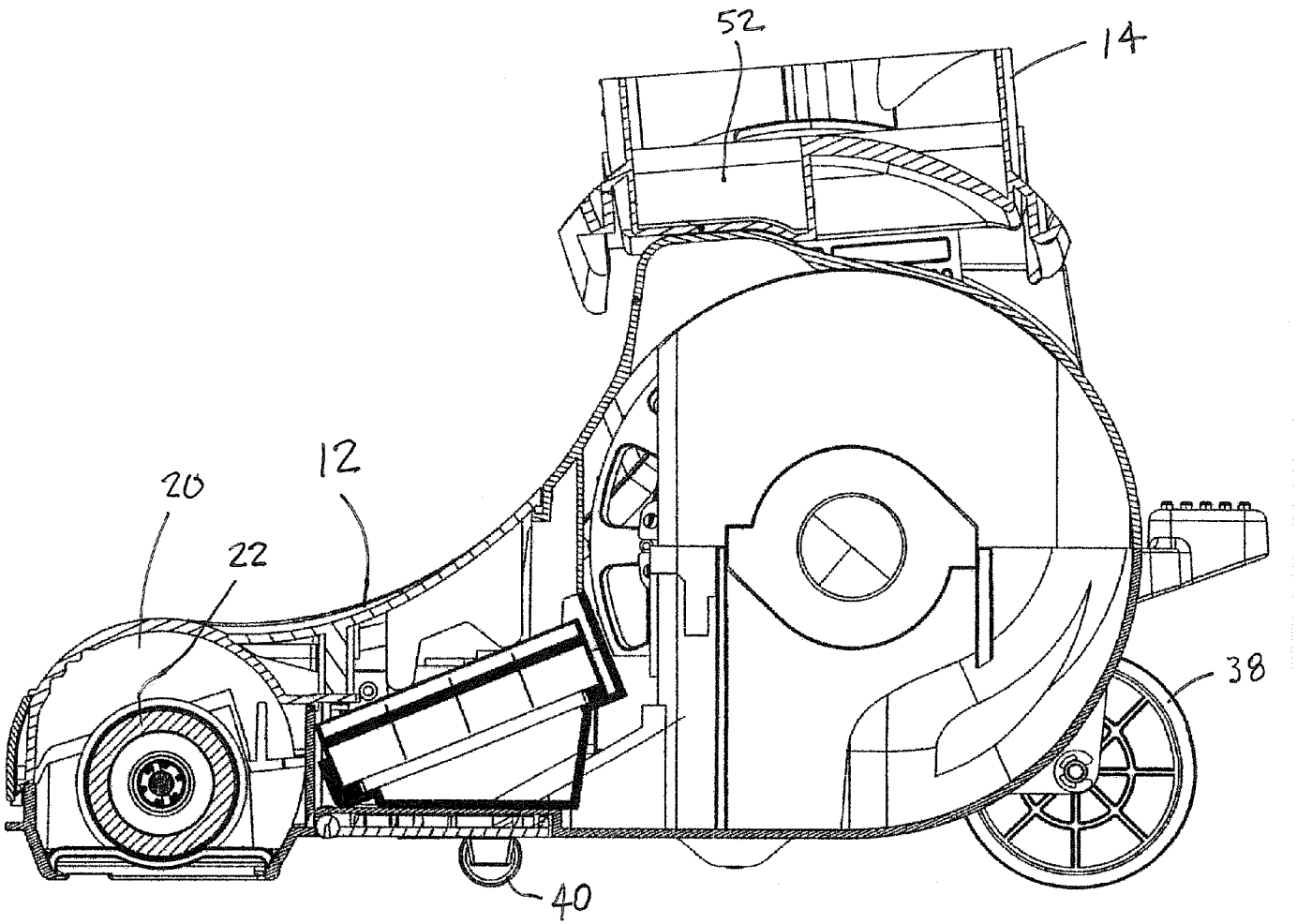

As further illustrated in FIGS. 9*a* and 9*b*, a first cam structure 70 is provided on the nozzle assembly 12 while a second cooperating cam structure 72 is provided on the handle assembly 14. These cooperating cam structures 70, 72 become engaged as the handle assembly 14 is moved forward relative to the nozzle assembly 12 toward an upright position from an inclined operating position as illustrated in FIG. 2*b* so that the handle assembly 14 is oriented substantially vertically over the nozzle assembly 12 in a stable storage position as illustrated in FIG. 2*a*. Thus, the handle assembly 14 is centered over the nozzle assembly 12 in the storage position and not left angled to the right or left on the trunion 52.

Figure 10A:
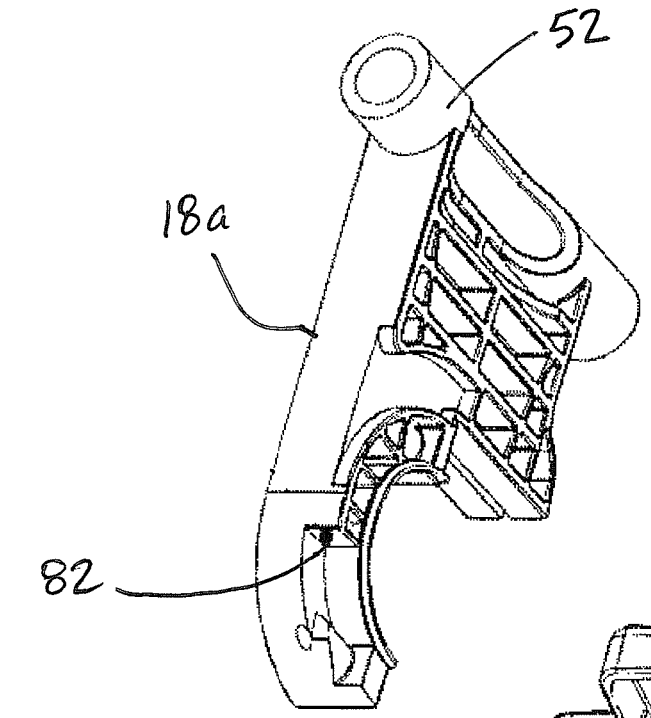
FIGS. 10*a*-10*c* are, respectively, a detailed perspective view of the first latching cam on the connector arm, the second cooperating latching cam on the release pedal and a detailed cross sectional view through the nozzle assembly illustrating the entire latch assembly in position to lock the handle assembly in the upright storage position.
Figure 10B:
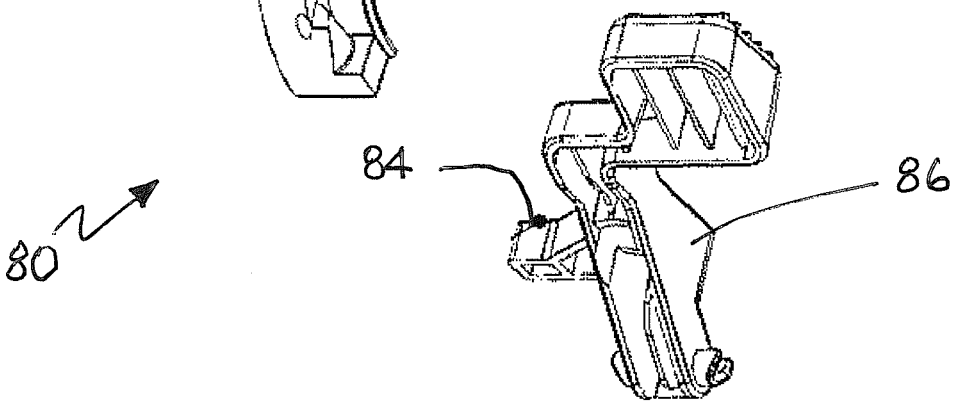
Figure 10C:
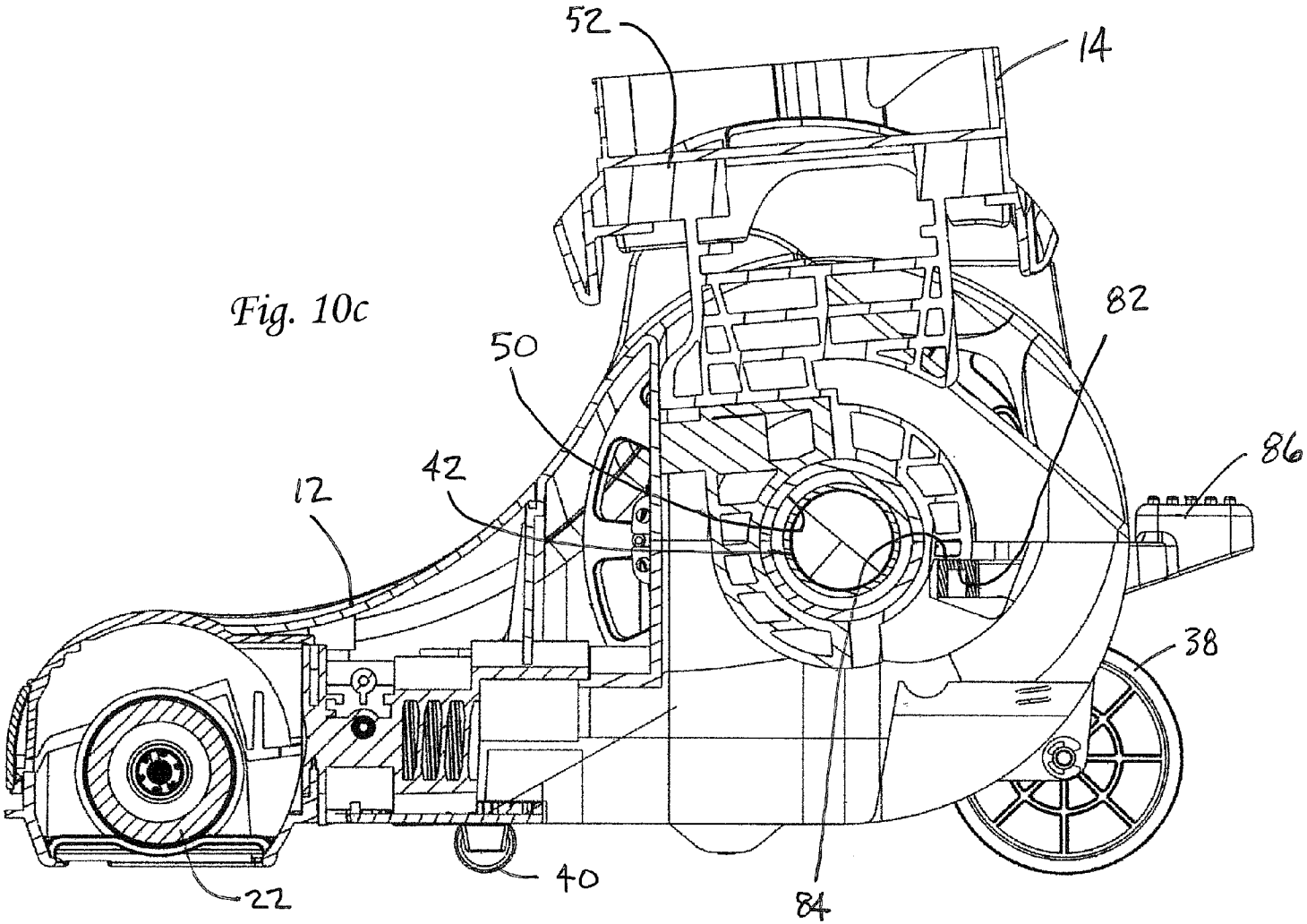

A latch assembly, generally designated by reference numeral 80 functions to lock the handle assembly 14 in the storage position. As illustrated in FIGS. 10*a*-10*c*, the latch assembly 80 includes a first latching cam 82 provided on the connector arm 18 and a second, cooperating latching cam 84 provided on a latch release pedal 86 that is pivotally mounted to the nozzle assembly 12. FIG. 10*c* illustrates the latch assembly 80 with the two cams 82, 84 engaged to lock the handle assembly 14 in the upright, storage position. The foot pedal 86 is depressed to disengage the cams 82, 84 and allow the handle assembly 14 to be inclined into an operative position (see also FIGS. 2*a* and 2*b*) when desired to conduct cleaning.

The foregoing description of the preferred embodiments have been presented for purposes of illustration and description. It is not intended to be exhaustive or to limit the invention to the precise form disclosed. Obvious modifications or variations are possible in light of the above teachings. The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiments do not and are not intended to limit the ordinary meaning of the claims in their fair and broad interpretation in any way.

What is claimed:

1. An upright vacuum cleaner, comprising:

a body including a nozzle assembly and a handle assembly, said nozzle assembly including a suction inlet and a pivot;

a suction generator carried on said body;

a dirt collection vessel carried on said body;

a connector arm pivotally connecting said handle assembly to said nozzle assembly, said connector arm including (a) a hub received on said pivot so as to provide a first pivotal connection along a first axis and (b) a trunion providing a second pivotal connection about which said handle assembly is tilted.

2. The vacuum cleaner of claim 1 wherein said pivot is an airstream conduit carried on said nozzle assembly.

3. The vacuum cleaner of claim 2, wherein said airstream conduit provides a fluid connection between said dirt collection vessel and said suction generator.

4. The vacuum cleaner of claim 3, wherein said handle assembly further includes a receiver that receives and holds said trunion.

5. The vacuum cleaner of claim 4, further including a pin securing said handle assembly to said trunion of said connector arm.

6. The vacuum cleaner of claim 5, wherein said receiver includes a socket that receives a first end of said trunion.

7. The vacuum cleaner of claim 6, wherein said pin is received in a second end of said trunion.

8. The vacuum cleaner of claim 7, wherein said connector arm includes a first portion and a second portion, said first and second portions being connected together so as to form said hub.

9. The vacuum cleaner of claim 8, wherein said trunion is provided on said first portion.

10. The vacuum cleaner of claim 9, further including a rotary agitator carried on said nozzle assembly.

11. The vacuum cleaner of claim 10, wherein said suction generator is carried on said nozzle assembly and said dirt collection vessel is carried on said handle assembly.

12. The vacuum cleaner of claim 11, wherein said dirt collection vessel is a filter bag.

13. The vacuum cleaner of claim 11, wherein said dirt collection vessel is a dirt cup.

14. The vacuum cleaner of claim 13, wherein said dirt cup includes a cyclone separator.

15. The vacuum cleaner of claim 14, wherein said dirt cup includes a primary filter.

16. The vacuum cleaner of claim 1, including a first cam structure on said nozzle assembly and a second cam structure on said handle assembly, said first and second cam structures becoming engaged as said handle assembly is moved toward an upright position whereby said handle assembly is oriented vertically over said nozzle assembly in a stable, storage position.

17. The vacuum cleaner of claim 16, further including a latch assembly for locking said handle assembly in said storage position.

18. The vacuum cleaner of claim 1, wherein said handle assembly further includes a receiver that receives and holds said trunion.

19. The vacuum cleaner of claim 18, further including a pin securing said handle assembly to said trunion of said connector arm.

20. The vacuum cleaner of claim 19, wherein said receiver includes a socket that receives a first end of said trunion.

* * * * *